US005522214A

United States Patent [19]

Beckett et al.

[11] Patent Number: 5,522,214

[45] Date of Patent: Jun. 4, 1996

[54] FLEXURE BEARING SUPPORT, WITH PARTICULAR APPLICATION TO STIRLING MACHINES

[75] Inventors: Carl D. Beckett, Vancouver; Victor C. Lauhala, Richland; Ron Neely, Kennewick; Laurence B. Penswick, Richland; Darren C. Ritter, Benton City; Richard L. Nelson, Pasco, all of Wash.; Burnell P. Wimer, Boise, Id.

[73] Assignee: Stirling Technology Company, Kennewick, Wash.

[21] Appl. No.: 105,156

[22] Filed: Jul. 30, 1993

[51] Int. Cl.[6] ..... F01B 7/00; F02G 1/043

[52] U.S. Cl. ..... 60/517; 60/520; 92/84; 267/161

[58] Field of Search ..... 60/517, 520; 92/84; 267/161

[56] References Cited

U.S. PATENT DOCUMENTS

| | | | |
|---|---|---|---|
| Re. 29,518 | 1/1978 | Franklin | 60/520 |
| 3,240,073 | 3/1966 | Pitzer | 267/161 |
| 4,015,913 | 4/1977 | Nakamura | 92/84 |
| 4,077,216 | 3/1978 | Cooke-Yarborough | 60/520 |
| 4,397,155 | 8/1983 | Davey | 62/6 |
| 4,475,335 | 10/1984 | Davey | 60/520 |
| 4,532,766 | 8/1985 | White et al. | 60/517 |
| 4,798,054 | 1/1989 | Higham | 62/6 |
| 4,967,558 | 11/1990 | Emigh et al. | 60/520 |
| 5,003,777 | 4/1991 | Berchowitz | 60/520 |
| 5,351,490 | 10/1994 | Ohishi et al. | 60/520 |

FOREIGN PATENT DOCUMENTS

| | | | |
|---|---|---|---|
| 0101249 | 6/1985 | Japan | 60/517 |

OTHER PUBLICATIONS

Ross, B., "Conceptual Design of a Long-Life, 10 Watt Stirling Generator Set," 26th Intersociety Energy Conversion Engineering Conference, Paper No. 910512, vol. 5, 1991, pp. 186–191.

Davey and Orlowska, "Miniature Stirling Cycle Cooler," *Cryogenics*, vol. 27, Mar. 1987, pp. 148–151.

Werrett, et al., "Development of a Small Stirling Cycle Cooler for Spaceflight Applications," (publication unknown), pp. 791–799.

*Primary Examiner*—Leonard E. Heyman

*Attorney, Agent, or Firm*—Wells, St. John, Roberts, Gregory & Matkin

[57] ABSTRACT

The use of flexures in the form of flat spiral springs cut from sheet metal materials provides support for coaxial nonrotating linear reciprocating members in power conversion machinery, such as Stirling cycle engines or heat pumps. They permit operation with little or no rubbing contact or other wear mechanisms. The relatively movable members include one member having a hollow interior structure within which the flexures are located. The flexures permit limited axial movement between the interconnected members, but prevent adverse rotational movement and radial displacement from their desired coaxial positions.

27 Claims, 6 Drawing Sheets

FLEXURE BEARING SUPPORT, WITH PARTICULAR APPLICATION TO STIRLING MACHINES

The Government has rights in this invention pursuant to Contract No. DE-FG03-90ER80864 awarded by the U.S. Department of Energy.

TECHNICAL FIELD

This invention relates to internally mounted flexure bearing assemblies for coaxial non-rotating linear reciprocating members used in power conversion machinery, such as a compressor, Stirling cycle engine or heat pump.

BACKGROUND OF THE INVENTION

Coaxial non-rotating linear reciprocating members in power conversion machinery, such as Stirling cycle machines, incorporate coaxial reciprocating elements with associated internal and/or external seals. The sealing functions are typically provided by means of sliding or rubbing surfaces in contact with one another, which result in wear, detrimental seal leakage and machinery lifetimes of uncertain duration.

Means previously identified for avoiding these life and reliability limitations include 1) gas bearing supports/seals, 2) lubricated bearings with hermetic bellows seals to prevent lubricant ingress to the working cycle region, and 3) flexural bearings used in conjunction with clearance seals.

The present invention arose from an effort to improve the implementation of flexural bearings and clearance seals. The general advantages of flexural bearings relative to gas bearings include the following: lower cost resulting from reduced precision manufacturing steps; higher reliability resulting from elimination of ports subject to plugging and reduction of sensitivity to very small particles; less frictional wear and less generation of unwanted debris resulting from elimination of rubbing contact during startup and shutdown; provision of some or all of the axial spring force required to resonate the moving component; and reduced complexity by avoiding the gas bearing actuation function and in some cases eliminating a gas return spring.

The existing state of the art in flexural bearings and clearance seals is well illustrated by U.S. Pat. No. 4,475,335. It illustrates use of stacks of circular sheet metal flexures with three legged spiral kerfs between an outside diameter clamp ring and an inside diameter clamp ring, such that the flexures function as bearing supports.

Two flexure bearing stacks are axially displaced one from another in the referenced patent disclosure. Both are clamped rigidly near their outside diameter in a common housing. The inner diameters are similarly affixed to a reciprocating rod which is relatively free to move axially. The flexure bearings rigidly resist any tendency toward radial motion.

A reciprocating linear drive motor is disposed between or outboard of the flexure bearing stacks and affixed to the rod such that it can impart forced oscillation of the rod, typically at a frequency which is resonant with the mass-spring-damper system natural frequency of the reciprocating subassembly.

A piston is attached to a cantilevered extension of the rod axially beyond the set of flexure bearings. The piston reciprocates within a surrounding cylinder which is rigidly coupled to the bearing housing and constrained to be substantially coaxial with the flexure bearing supports. A very tight clearance seal between the piston and cylinder is provided to minimize cyclic leakage of the working gas between the regions at each end of the piston.

BRIEF DESCRIPTION OF THE DRAWINGS

Preferred embodiments of the invention are described below with reference to the accompanying drawings, which are briefly described below.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

The basic elements of the invention are described with reference to conventional components of an integral, free-piston Stirling cycle refrigerator. The features disclosed in this invention have general application to support of other non-rotating linear reciprocating members used within power conversion machinery, such as a split Stirling refrigerator, any configuration of Stirling engine, a fluid compressor, a pump, a linear alternator or generator, and other thermodynamic cycle devices which require linear reciprocation of a displacer and/or piston, such as the expander portion of a Gifford McMahon cooling machine.

Figure 1:
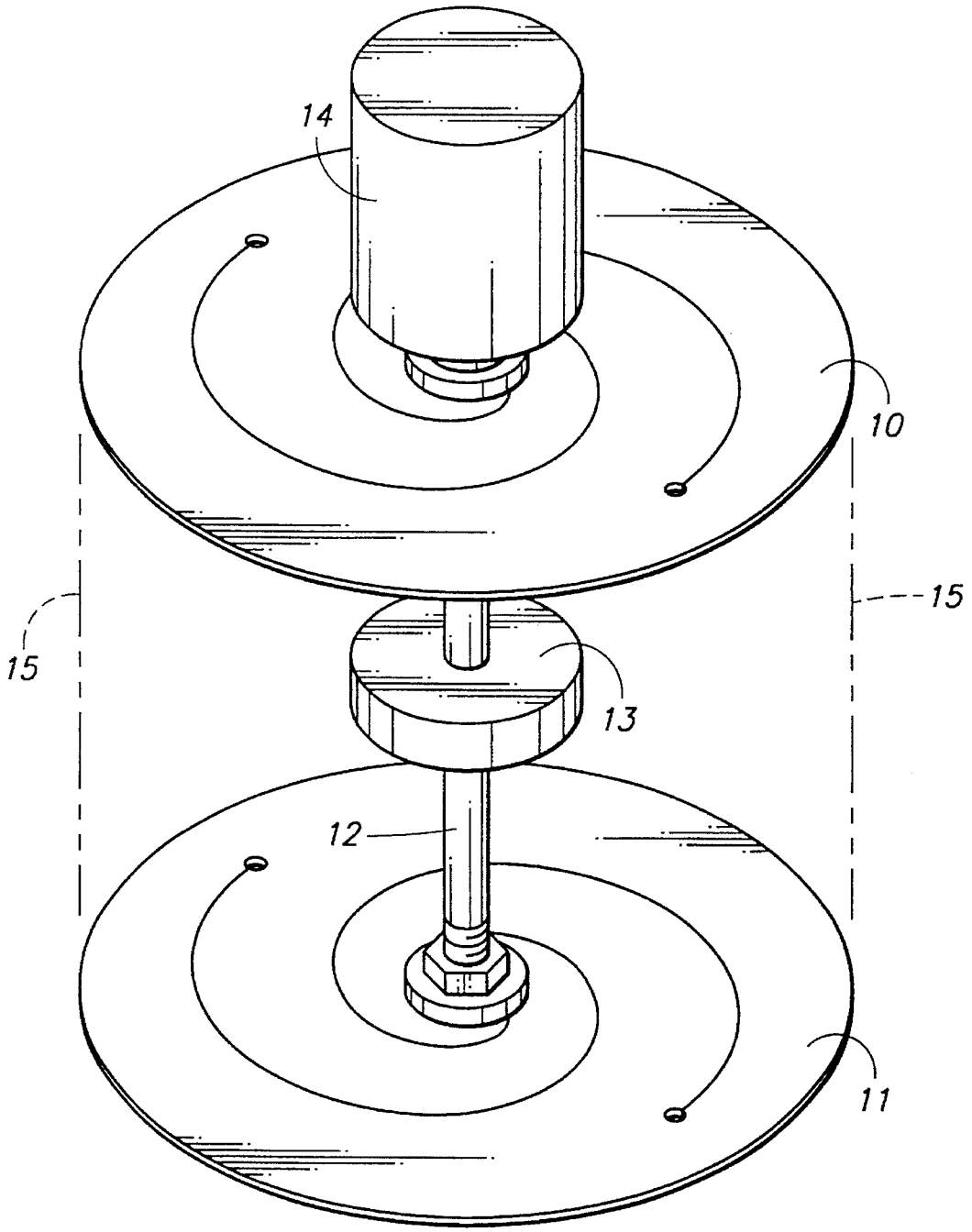
Fig 1 PRIOR ART
FIG. 1 is a schematic perspective view of the prior art use of flexure bearings when incorporated within an illustrative power conversion machine.

FIG. 1 schematically illustrates conventional support of reciprocating members by use of sheet metal flexible bearings. It shows such bearings 10 and 11 spaced along a reciprocating shaft 12 that interconnects a linear actuated device 13, and an engine or compression piston 14. The illustrated components are located within a supporting structural housing, generally illustrated by the surrounding dashed lines 15. In the case of a Stirling cycle machine, moving and stationary components, such as a displacer and displacer cylinder, respectively, are also attached to the illustrated flexure stack to form a non-contacting bearing and seal system.

Functioning as a refrigerator or heat pump, the reciprocating motion of piston 14 is actuated by a linear drive motor 13. Functioning as an engine, the motion of piston 14 is actuated by pressure differences across its face and the linear drive motor 13 becomes a linear alternator which extracts energy from the piston motion by converting it into electricity.

Non-contact clearance seals about the relatively moving elements are maintained by the high radial stiffness of the flexure stack during all modes of operation. In contrast, gas bearings do not achieve non-contact until a sufficient rotational speed has been achieved for hydronamic bearings or a sufficient gas supply pressure has been achieved for hydrostatic bearings.

Intrinsic to flexural bearings is the capacity to provide a significant portion or all of the axial spring forces required for free-piston engine dynamics. This eliminates the need for gas springs or conventional mechanical springs and their related performance losses and mechanical complexity. The spring features of flexural bearings also have the inherent quality of providing axial centering of the reciprocating elements required of free piston devices, thus eliminating performance losses and decreased reliability associated with using other centering technologies, such as pneumatic centering ports.

Flexures 10 and 11 are coaxially aligned with the bore of cylinder walls formed within housing 15 adjacent to the piston 14. They are designed to provide appropriate axial compliance and radial stiffness such that piston 14 can oscillate axially at its design stroke with no contact normally occurring between it and the cylinder walls.

As used herein, the terms "flexure" and "flat spiral spring" are used interchangeably to describe springs formed from a flat sheet of metal having spiral kerfs cut through it. A flexure can comprise a single flat spiral spring or a stacked plurality of closely adjacent springs that are clamped between the moving members and work in unison. The preferred flexure material for most applications is Sandvik 7C27Mo2 flapper valve Steel (Stainless), available through Sandvik Steel Company, Strip Products Division, Benton Harbor, Mich. The high strength and fatigue resistant nature of this material contribute to reducing the size and weight of the flexure assembly, in comparison with most other readily available candidate materials.

Figure 2:
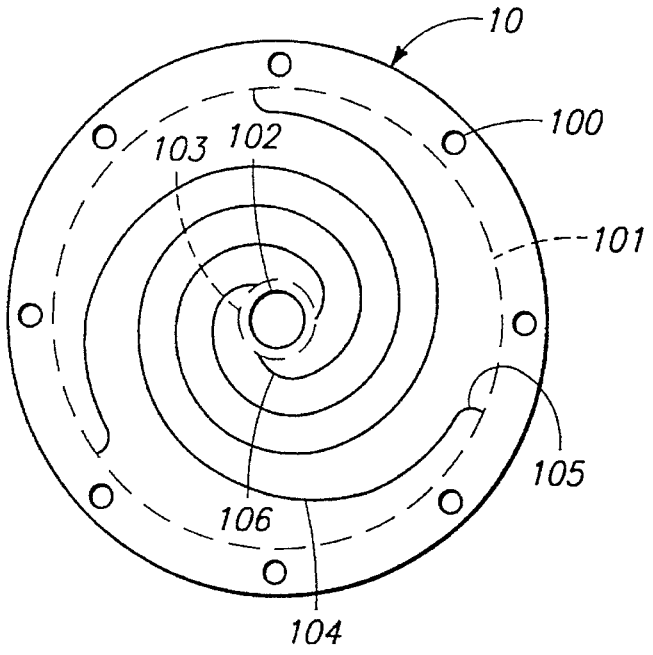
FIG. 2 is a plan view of a typical planar flexure.

FIG. 2 is a plan view of a planar flexure 10. As illustrated, the flexure 10 consists of a circular disk of flat sheet metal with attachment holes 100 distributed near its outer periphery. Clamping of individual flexures 10 within a stack is achieved by mounting bolts (not shown) which pass through holes 100 and associated rigid annular clamping rings to secure the flexure between the inner clamping diameter 101 and the outside edge or periphery of the flexure. Thin washer shaped spacers (not shown), which are typically deployed between adjacent flexures in a stack, fill the gap between inner clamping diameter 101 and the outer flexure edge. Aligned holes are provided in the spacers for receiving the mounting bolts.

The flexure 10 is clamped at its center between a central mounting hole 102 and clamping diameter 103. If spacers are used in the outer region, others of the same thickness with an outside diameter equivalent to the diameter 103 and an inside diameter equivalent to the diameter of hole 102 are used in the inner clamping region.

Spiral cut kerfs 104 between outer diameter 101 and inner diameter 103 form the arm(s) of the flexure 10. Three arms are illustrated in FIG. 2, but versions with one, two and three arms have been successfully implemented in practice. Selecting the best shape for the flexure arms is a compromise between conflicting objectives. Objectives are a high axial displacement capability, high surging natural frequency, and a high radial stiffness, while maintaining stresses well below the endurance limit to provide essentially infinite flex life. The arm design can be optimized using a finite element analysis code to maintain stresses as nearly uniform as possible throughout the arm(s) during extension. The desired axial stiffness and radial stiffness can be obtained by selecting the thickness of individual flexures and the total number of flexures in a bearing stack to achieve the desired set of characteristics. Material selection is also a very important parameter which can significantly impact the functionality of the design.

The process used for cutting kerf 104 is likewise very important. If the process leaves microscopic damage adjacent to the kerf 104, localized stress risers can lead to premature failure. The preferred methods identified to date are chemical milling and abrasive water jet cutting. The kerf 104 treatment at the ends 105 and 106 is likewise important to avoid stress risers. One technique successfully demonstrated is the turnout of kerf end 105 as illustrated in FIG. 2 to avoid terminating at a shallow angle to the clamping diameter 101. Another successful approach used at both kerf ends 105 and 106 is to provide a relief transition by widening the kerf near the end to have a rounded transition from the kerf to solid material, as generally shown in FIG. 1.

The flexure 10 as shown in FIG. 2 has a circular outer configuration or edge. It is designed for use in cylindrical machine applications where coaxial inner and outer cylindrical surfaces are to be maintained in close proximity to one another. However, the described usage of flexures and the advantages derived from their usage, are not limited to applications involving cylindrical components. The guided components and the flexure shapes can be noncircular in cross-sectional configuration. As an example, linear motors or alternators can be designed for improved performance and manufacturability in power generation by utilizing a rectangular cross-sectional configuration.

The flexures can be used within a single supporting stack or within two or more axially spaced stacks. The use of at least two axially spaced stacks of flat springs provides increased directional support to the interconnected components by spacing the radially stiff members along the central reference axis.

Figure 3:
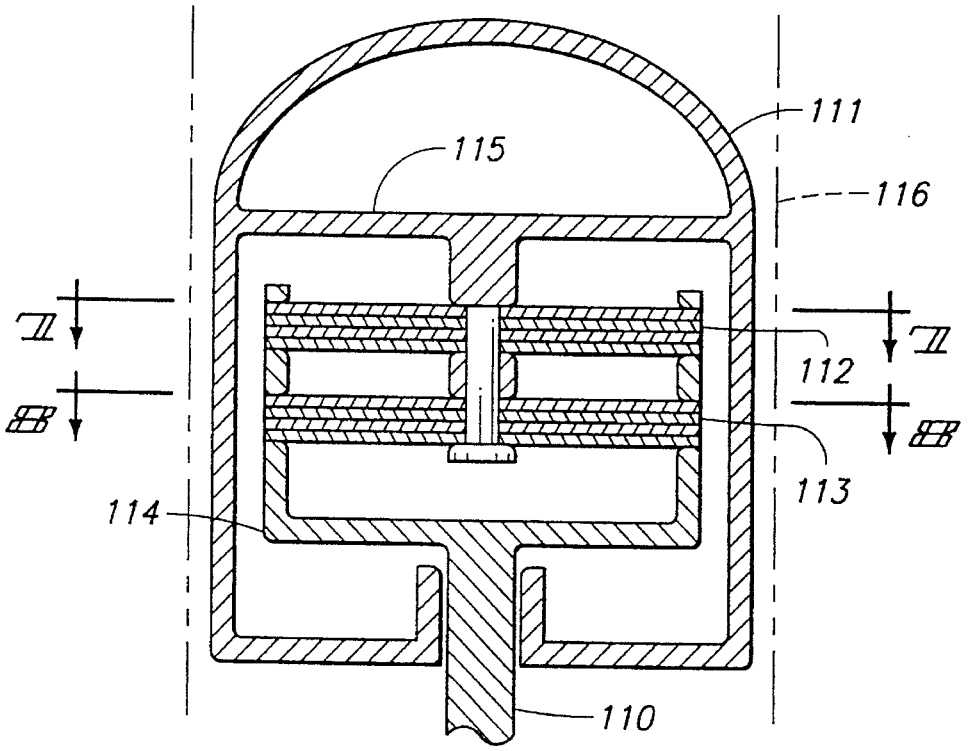
FIG. 3 is a schematic cross-sectional view of one embodiment of the invention.
Figure 7:
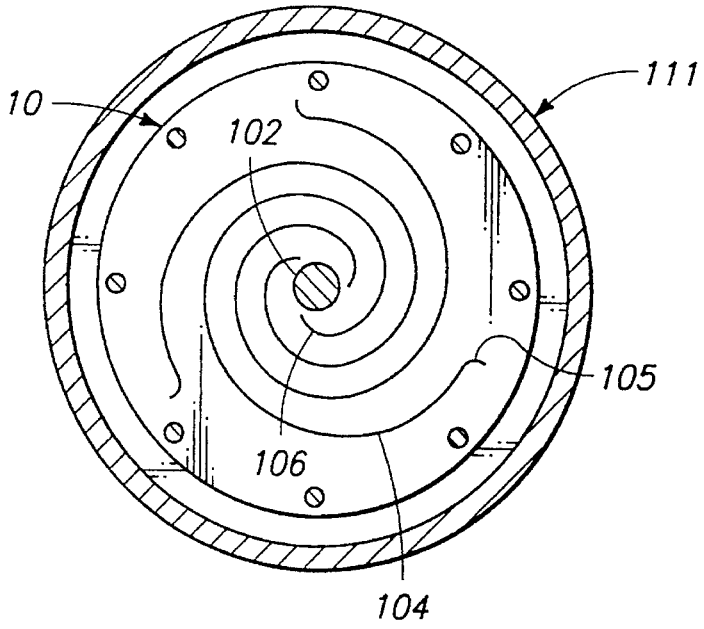
FIG. 7 is a sectional view taken along line 7—7 in FIG. 3.
Figure 8:
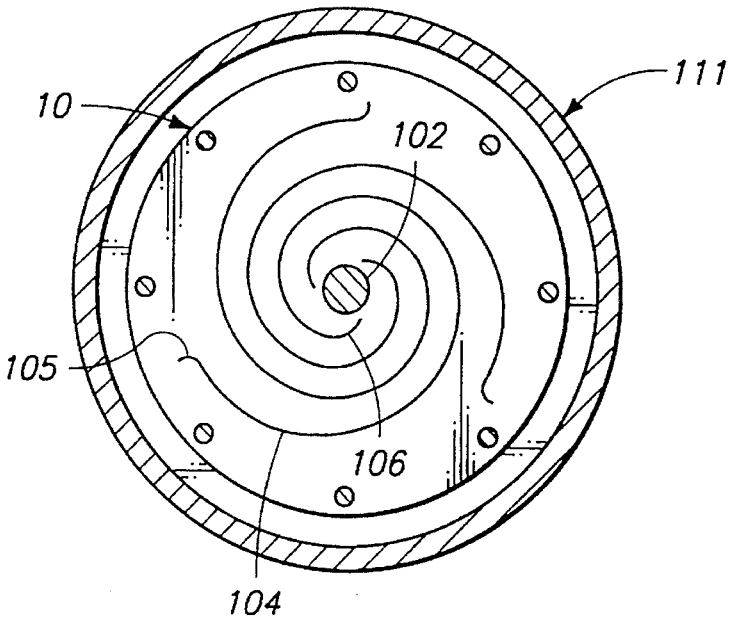
FIG. 8 is a sectional view taken along line 8—8 in FIG. 3.

By reversing the orientation of the spiral kerfs in the respective stacks, one can balance the rotational motions or forces between the relatively moving members that result from relative axial motion between them See FIGS. 3, 7 and 8. This is of particular significance when providing support between non-cylindrical components, where even slight relative rotation of the components will affect performance or alignment.

The present internally mounted flexure bearing assembly can be utilized to assist in controlling motion of any coaxial non-rotating linear reciprocating members in power conversion machinery, such as heat engines, heat pumps, compressors, linear alternators, etc. It pertains to placement of the flexures to minimize the space requirements and to avoid interference with volumetric needs of associated gaseous chambers often encountered in such equipment. The flexures are joined between two relatively movable members, which might be a piston and housing, a displacer and housing, a displacer and piston, or any other combination of axially movable components in power conversion machinery. In such instances, the machinery will include a first member centered about a reference axis and a coaxial second member. One of the first and second members will have a hollow interior structure within which the flexures are totally or partially mounted. The machinery also will include means for imparting relative reciprocating motion between the first and second members along the reference axis. In the case of engines, this "means" might constitute a heat activated mechanism. In the case of a heat pump or compressor, it might constitute an externally powered mechanical mechanism.

Flexure means, which might constitute one or more flat spiral springs, are positioned across the hollow interior structure of the second member in a coaxial relationship with it. The flexure means includes radially spaced connections to the first and second members, respectively, for accommodating relative axial movement and maintaining coaxial alignment between them. These functions are derived from the inherent properties of such flat springs in providing relatively light restoring forces in the axial direction, in comparison with stiff resistance to radial movement.

Figure 6:
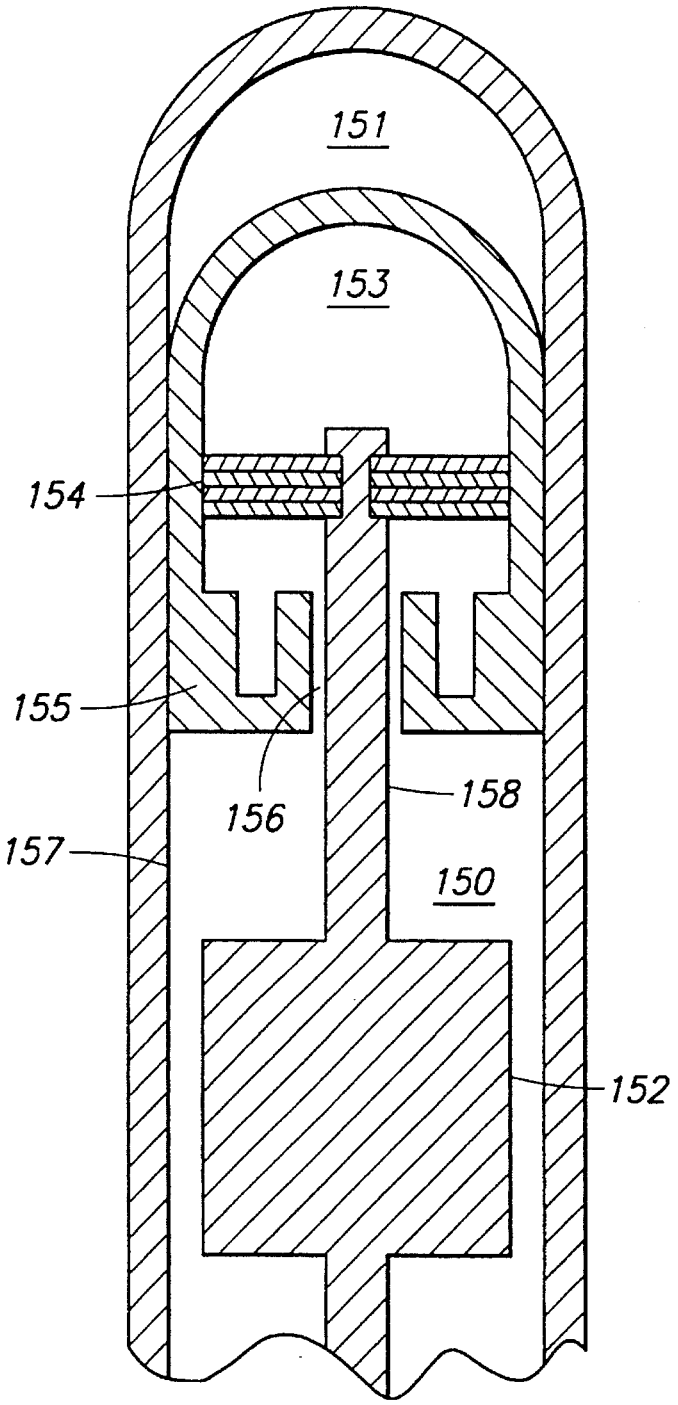
FIG. 6 is a schematic cross-sectional view of a fourth embodiment of the invention.

As noted previously, in the simplest case, one of the members, such as a supporting housing or frame, will be stationary and the other will be mounted for reciprocation within it. However, it is to be understood that the first and second members can each be coaxially mounted within a third member, such as a housing, for independent coaxial reciprocating motion relative to one another and the third member. An example would be a free piston Stirling cycle refrigeration unit, where a displacer and a compressor piston are each independently movable within a supporting housing. The flexure bearing assembly can be operatively interconnected between the displacer and the piston for supporting them relative to one another even though their movements are out of phase. A schematic example of such an arrangement is illustrated in FIG. 6.

Figure 4:
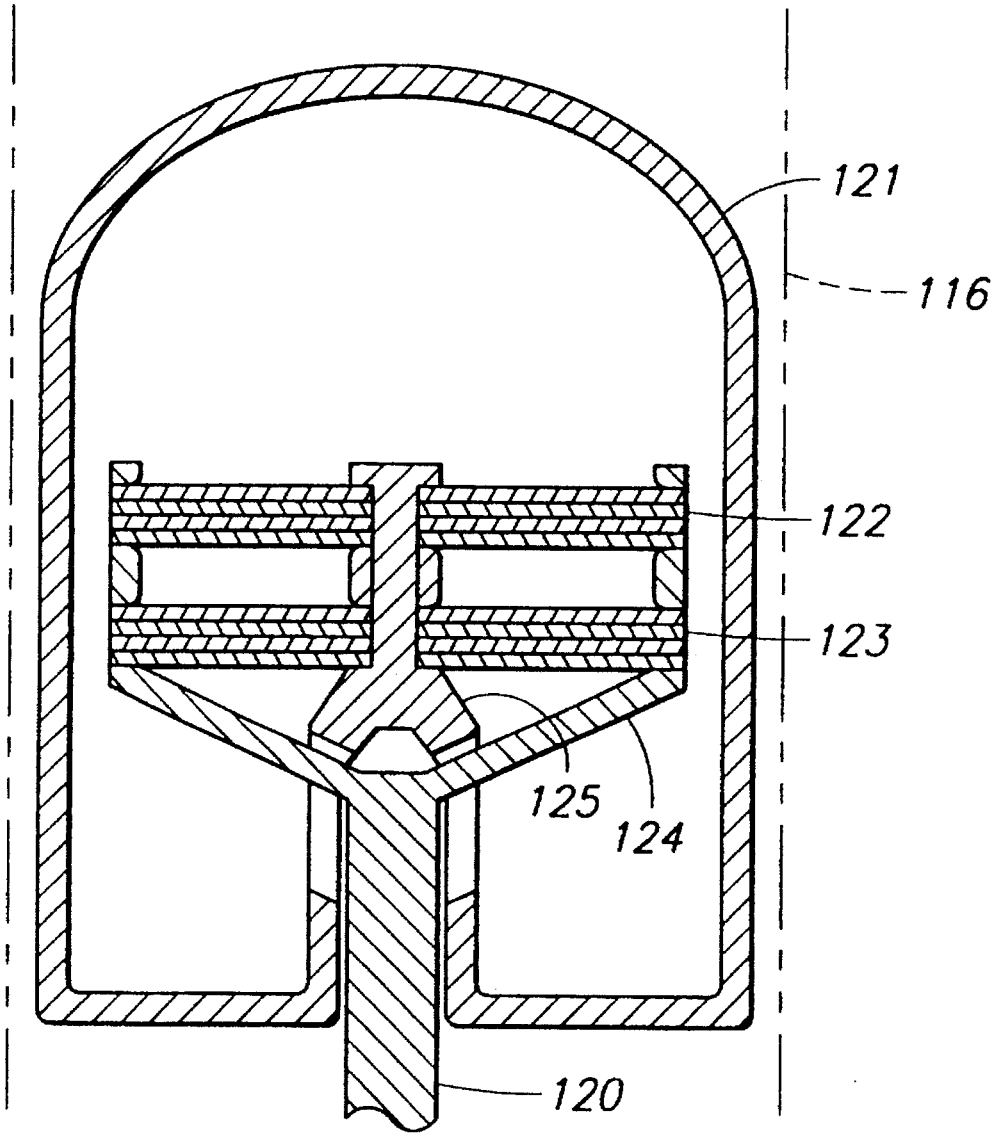
FIG. 4 is a schematic cross-sectional view of a second embodiment of the invention.
Figure 5:
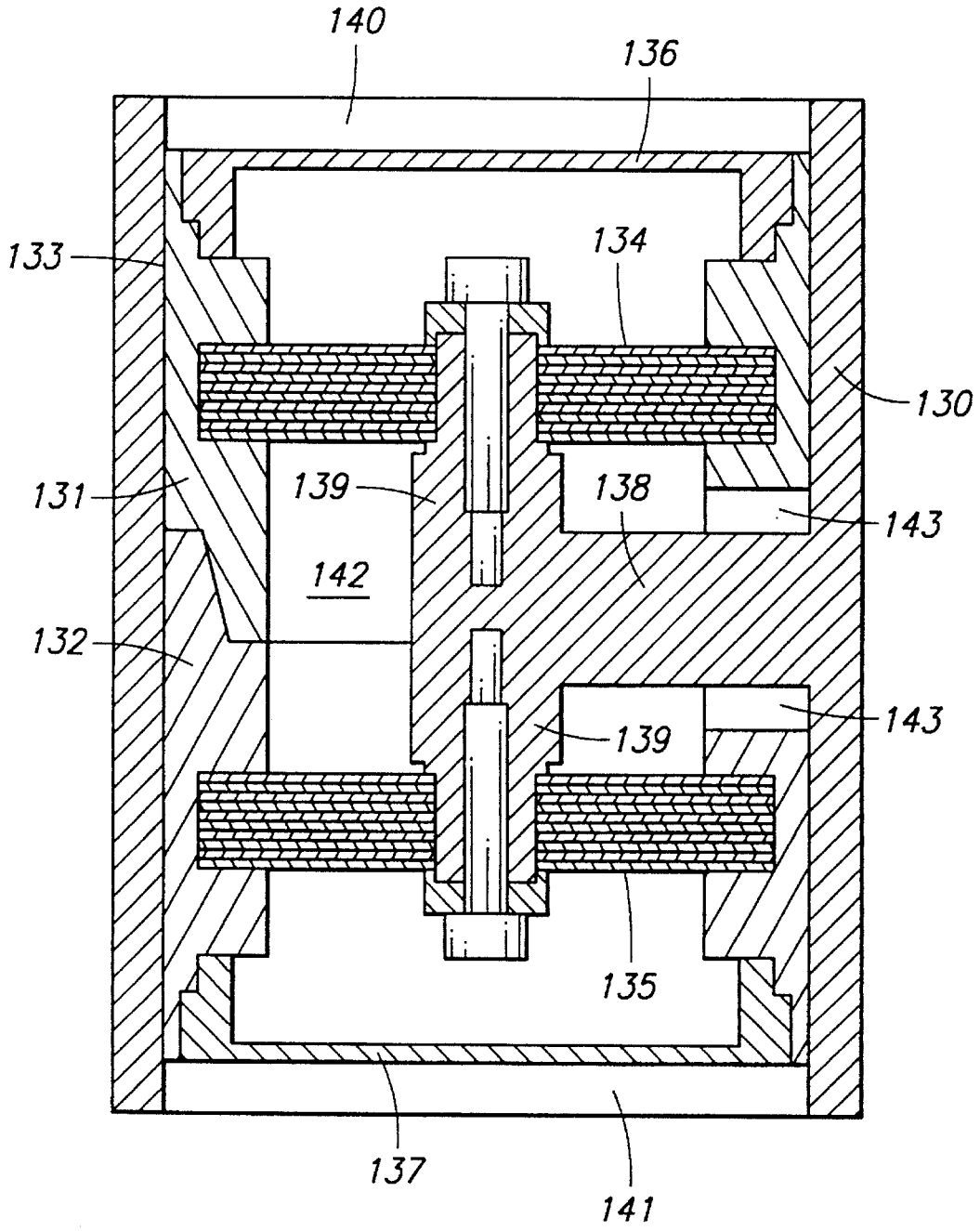
FIG. 5 is a schematic cross-sectional view of a third embodiment of the invention.

The flexure means can take the form of a flat spiral spring fixed at its center to the first member and fixed about its periphery to the hollow interior structure of the second member. An example of such a support arrangement is illustrated in FIG. 5. Alternately, the flat spiral spring can be fixed at its center to the second member and fixed about its periphery with respect to the first member, as schematically illustrated in FIGS. 3 and 4.

In many instances, the flat spiral spring will be fixed to a frame coaxially supported on one of the relatively movable members. FIG. 3 illustrates an arrangement where the flat spiral spring is fixed at its center to one member and fixed about its periphery to a frame within the interior structure of the second member which is coaxially supported on the remaining member. FIG. 4 shows the flat spiral spring fixed at its center to a first frame coaxially supported on one member and fixed about its periphery to a second frame coaxially supported on the remaining member. In this instance, the first and second frames are axially and radially interfitted within the interiors structure of the second (hollow member) for axial motion relative to one another.

FIG. 5 illustrates an arrangement where the flat spiral spring is fixed at its center to a frame structurally integral with a first member and located within a interior structure of a second (hollow) member. In FIG. 4 the flat spiral spring is fixed at its center to the second (hollow) member, the flat spiral spring being fixed about its periphery to a frame structurally integral with the first member and located within the interior structure of the second member.

FIG. 5 illustrates application of the invention to a double acting member that reciprocates along the reference axis and is formed with axial symmetry, having a piston with clearance seals at each end. The flexure means in this instance includes first and second flat spiral springs fixed at their respective centers to opposed coaxial posts formed integrally with the first member and extending through the second (hollow) member. The flat spiral springs are fixed about their respective peripheries to the interior structure of the second member.

As will be obvious from a detailed study of the enclosed illustrations, there are numerous combinations of flexure placement available within the scope of this disclosure. Common to all of them is physical placement of the flexures within the confines of a hollow member that is axially reciprocated relative to the second member to which the flexure is operably connected.

FIG. 3 is a schematic representation of an apparatus in which the flexure support bearings are mounted internally to a displacer or piston. There are advantages to having the moving member attached to the inner part of the flexure bearings because less flexure mass is then subject to the acceleration loads, which improves flexure dynamics.

In FIG. 3, fixed support rod 110, which can be structurally integral with another moving member or with the supporting housing (as illustrated by dashed line 116), is rigidly attached to an internal fixed frame 114. The rigid frame 114 attaches to a pair of axially spaced flexure bearings 112 and 113 at their respective outer peripheries. The moving displacer 111 includes an internal structure or frame 115 which attaches to the centers of the flexure bearings 112 and 113.

FIG. 4 is a schematic representation of a variant of the mounting approach shown in FIG. 3 and which achieves the same results. As with FIG. 3, a support rod 120 leads from another moving member or the surrounding housing 126 and is rigidly attached to an internal frame 124 which in turn is fixed to the peripheries of flexure bearings 122 and 123. The moving displacer 121 attaches more directly to the inner part of flexure bearings 122 and 123 through a separate coaxial frame 125. The added complexity is that the fixed frame 124 must have cantilever or spider legs to interfit and penetrate through matching slots in moving frame 125 to avoid contact between structures 124 and 125 during operation. The advantage gained by use of the FIG. 4 approach is a simplified internal displacer structure having a lower moving mass. This is partially offset by some increased complexity in the interaction between fixed frame 124 and moving member 125.

FIG. 5 is a simplified cross-sectional illustration of an approach for mounting flexure bearing supports on a double acting piston. Only the portion relevant to the flexure bearing attachment is shown. In practice the cylinder would be extended on each end and, in an engine application, a hot cap or Heylandt crown would be added to the hot end of the piston. The surrounding piston cylinder 130 also functions as a fixed frame leading to opposed axial posts 139 to which the piston assembly is attached by means of the flexure bearings 134 and 135.

The internal support post portion 139 of cylinder 130 is attached to the cylinder 130 by one or more spider legs 138. Cylinder 130 is illustrated for convenience as a continuous piece, but it could in fact be an assembly of components. The piston sleeve 132 is attached to piston sleeve 131. Both piston sleeves 131 and 132 are provided with cutouts 143 to avoid interference between the sleeves 131, 132 and the spider leg(s) 138.

The flexure bearing assembly 134 is attached to one of the opposed support posts 139 at its center and to the interior of piston sleeve 131 at its outer periphery. Flexure bearing assembly 135 is attached to the remaining support post 139 at its center and to piston sleeve 132 at its outer periphery. Flexure clamping procedures assure that piston sleeves 131 and 132 form a clearance seal 133 relative to cylinder 130.

A solid piston end cap 136 isolates cyclic pressure variations in adjacent cycle working fluid 140 from the average cycle pressure in the piston interior region 142. As is common practice with Stirling machines, an orifice between working fluid region 140 and piston interior region 142 allows region 142 to assume the average pressure of region 140, but prevents rapid exchange of gas which would cause region 142 to act as a dead volume to working cycle 140 or 141. In an analogous manner, a solid piston end cap 137 attaches to lower piston sleeve 132 and isolates cyclic pressure variations in cycle working fluid 141 from the average pressure in region 142.

A clearance seal 133 formed between the inner and outer cylindrical surfaces of the cylinder 130 and piston sleeves 131, 132 limits the cyclic flow of working fluid between upper cycle region 140 and lower cycle region 141 to maintain acceptable flow related losses. The radial stiffness and accurate alignment provided by the interconnecting flexures 134 and 135 assures accurate continuation of the narrow tolerances required for such clearance seals in an operational machine in order to avoid frictional wear and to seal against the varying working gas pressures.

FIG. 6 is a schematic illustration of an approach for mounting displacer flexure bearing supports with respect to a moving piston rather than with respect to a fixed housing. In the approach illustrated, a common cylinder 157 surrounds axially reciprocating piston 152 and displacer 155. Displacer 155 shuttles working fluid between expansion space 151 and compression space 150.

In this schematic illustration, the suspension for piston 152 is not shown, but could be in the form of outboard flexures, as illustrated in the prior art referenced above.

Piston 152 is fitted with a displacer support post 158, which also functions as the displacer drive rod. Displacer 155 is supported as described above by flexure bearing supports 154 which are located internal to displacer 155 in displacer bounce space 153. The flexures 154 support displacer 155 with reference to displacer support post 158. Clearance seal 156 between displacer 155 and displacer support post 158 allows displacer bounce space 153 to attain the same average pressure as compression space 150, but provides enough flow resistance that leakage past seal 156 on a cyclic basis is small enough that flow losses are small. In this manner, bounce space 153 is effectively isolated from acting as a dead volume to compression space 150.

Various assembly approaches can be used to provide precision alignment of the flexures and associated machine components. One approach is to utilize differential thermal expansion of materials. For example, a cylinder and coaxial piston might be constructed from materials having different coefficients of thermal expansion. The complete assembly is then heated or cooled until the difference in thermal expansion between them reduces the clearance seal about the periphery of the piston to a point where the piston surfaces contact the cylinder surfaces, resulting in zero clearance. The clamping screws used to engage the interconnecting flexures can then be tightened to lock the flexures in place between the piston and cylinder structures. This will assure that the piston is concentric with respect to the cylinder when returned to ambient or working temperatures. If desired, shim material can be used to temporarily fill a portion of the clearance gap between the members as they are heated or cooled. This will minimize the change in temperature necessary to close the clearance gap for alignment purposes.

The thermal expansion approach might also be used with a piston and cylinder of the same material by using shims of a material having a high rate of thermal expansion. As the assembly is heated, the shim will expand and fill the clearance space between the cylinder and piston, thus precisely centering the piston.

Another accurate assembly approach is to surround the cylinder walls with a sealed hollow cylindrical pressure chamber and to utilize external pressure on the cylinder to achieve a symmetrical change in its diameter. By symmetrically squeezing the cylinder around the piston, the piston can be held tightly in a concentric position relative to the cylinder as the mounting clamps for the flexures are tightened. When the pressure or other symmetrical force is released about the cylinder, it will return to its original position with the piston remaining concentric to it. Shims can also be used in the gap between the cylinder and piston to minimize the amount of radial pressure necessary to clamp the cylinder around the piston.

Shims alone can be used to precisely align the flexures. By inserting precise shims between the cylinder and piston, one can mechanically locate the piston coaxially relative to the cylinder. A plurality of identical shims should be equally spaced about the cylinder and piston in the clearance space separating them. With the shims installed and holding the piston concentric to the cylinder, the clamping assemblies for the flexures can be tightened to assure the desired coaxial relationship between the two relatively movable members. The shims are subsequently removed prior to usage of the equipment.

As a final approach to alignment, low friction wear pads can be located between the inner and outer cylindrical surfaces of the relatively movable members. A material such as Teflon is appropriate. Separate pads can be equally spaced around the axial ends of the piston or cylinder in the clearance space separating them. They should be of a thickness necessary to fill the clearance space and to hold the piston concentric to the cylinder. With the piston installed and the wear pads holding the piston concentric to the cylinder, the clamping assemblies for the flexures can be tightened to assure that the members are concentric. The piston is then cycled to wear material from the surfaces of the wear pads to reduce rubbing friction between the piston and cylinder to an acceptable level. Continuous annular wear bands at the axial ends of the piston or cylinder can be used in place of separate pads. The wear band could be a lightly knurled surface of sufficient thickness to fill the clearance space between the piston and cylinder and to keep the piston centered with respect to the cylinder.

In compliance with the statute, the invention has been described in language more or less specific as to its features. It is to be understood, however, that the invention is not limited to the specific features described, since the means herein disclosed comprise preferred forms of putting the invention into effect. The invention is, therefore, claimed in any of its forms or modifications within the proper scope of the appended claims appropriately interpreted in accordance with the doctrine of equivalents.

I claim:

1. An internally mounted flexure bearing assembly for coaxial non-rotating linear reciprocating members in power conversion machinery, comprising:

a first member centered about a reference axis;

a coaxial second member having a hollow interior structure, the first member extending within the hollow interior structure of the second member;

one of the first and second members having a surface centered about the reference axis that partially forms a clearance seal including the surface of the one member;

means for imparting relative reciprocating motion between the first and second members along the reference axis; and a flexure in the form of at least one flat spiral spring positioned across the hollow interior structure of the second member, the flat spiral spring including radially spaced connections to the first and second members, respectively, for accommodating relative axial movement between the first and second members while maintaining the first and second members in coaxial alignment to assure effective operation of the clearance seal.

2. The flexure bearing assembly of claim 1, wherein the flat spiral spring is fixed at its center to the first member and is fixed about its periphery to the hollow interior structure of the second member.

3. The flexure bearing assembly of claim 1, wherein the flat spiral spring is fixed at its center to the first member and is fixed about its periphery relative to the first member.

4. The flexure bearing assembly of claim 1, wherein the flat spiral spring is fixed at its center to the first member and is fixed about its periphery to a frame that is coaxially supported on the second member and which extends within the interior structure of the second member.

5. The flexure bearing assembly of claim 1, wherein the flat spiral spring is fixed at its center to a frame that is structurally integral with the first member and which extends within the interior structure of the second member, the flat spiral spring being fixed about its periphery to the interior structure of the second member.

6. The flexure bearing assembly of claim 1, wherein the flat spiral spring is fixed at its center to the second member and is fixed about its periphery to a frame that is structurally integral with the first member and which extends within the interior structure of the second member.

7. The flexure bearing assembly of claim 1, wherein the second member is double acting and is formed with axial symmetry;

the flexure comprising:

first and second flat spiral springs fixed at their respective centers to opposed coaxial posts which are formed integrally with the first member and which extend through the second member, each flat spiral spring being fixed about its periphery to the interior structure of the second member.

8. The flexure bearing assembly of claim 1, wherein the flexure comprises at least two axially spaced stacks of flat springs.

9. The flexure bearing assembly of claim 1, wherein the flexure comprises:

at least two axially spaced stacks of flat springs;

each stack of flat springs consisting of flat metal sheets having spiral kerfs forming axially movable arms across them;

the orientation of the spiral kerfs in the respective stacks being reversed to balance rotational forces between the first and second members that result from relative axial motion between them.

10. The flexure bearing assembly of claim 1, wherein the power conversion machinery is a Stirling cycle machine.

11. The flexure bearing assembly of claim 1, wherein the first and second members are mounted within a coaxial third member for independent coaxial reciprocating motion of the first and second members relative to one another and to the third member.

12. The flexure bearing assembly of claim 1, further comprising:

a first frame coaxially supported on one of the first and second members;

the flat spiral spring being fixed at its center to the first frame;

a second frame coaxially supported on a remaining one of the first and second members;

the flat spiral spring being fixed about its periphery to the second frame;

the first and second frames being axially and radially interfitted within the interior structure of the second member for axial motion of the first and second flames relative to one another.

13. An internally mounted flexure bearing assembly for coaxial non-rotating linear reciprocating members in power conversion machinery, comprising:

a stationary housing;

a first member mounted within the housing, the first member having a surface centered about a reference axis;

a coaxial second member mounted within the housing, the second member having a surface centered about the reference axis, the surface of the second member being adjacent and complementary to the surface of the first member to form a clearance seal between the surface of the first member and the surface of the second member;

one of the first and second members having a hollow interior structure;

means for imparting relative reciprocating motion to the first and second members along the reference axis for independent coaxial reciprocating motion both relative to one another and to the housing; and a flexure in the form of at least one flat spiral spring positioned across the hollow interior of the one member, the flexure including radially spaced connections to the first and second members, respectively, for accommodating relative axial movement between the first and second members and for maintaining coaxial alignment between them to assure effective operation of the clearance seal.

14. The flexure bearing assembly of claim 13, wherein the flat spiral spring is fixed at its center to the first member and fixed about its periphery to the hollow interior structure of the one member.

15. The flexure bearing assembly of claim 13, wherein the one member is the displacer of a Stirling cycle machine.

16. The flexure bearing assembly of claim 13, wherein the flat spiral spring is fixed at its center to the second member and is fixed about its periphery relative to the first member.

17. The flexure bearing assembly of claim 13, wherein the flat spiral spring is fixed at its center to one of the first and second members and is fixed about its periphery to a frame coaxially supported on the remaining one of the first and second members within the interior structure of the second member.

18. The flexure bearing assembly of claim 13, wherein the flat spiral spring is fixed at its center to a frame that is structurally integral with the first member and which extends within the interior structure of the second member, the flat spiral spring being fixed about its periphery to the interior structure of the second member.

19. The flexure bearing assembly of claim 13, wherein the flat spiral spring is fixed at its center to the second member, the flat spiral spring being fixed about its periphery to a frame that is structurally integral with the first member and which extends within the interior structure of the second member.

20. The flexure bearing assembly of claim 13, wherein the second member is double acting and is formed with axial symmetry;

the flexure comprising:

first and second axially spaced flat spiral springs fixed at their respective centers to opposed coaxial posts that are formed integrally with the first member and which extend within the second member, the flat spiral springs being fixed about their respective peripheries relative to the interior structure of the second member.

21. The flexure bearing assembly of claim 13, wherein the flexure comprises:

at least two axially spaced stacks of flat springs.

22. The flexure bearing assembly of claim 13, wherein the flexure comprises:

at least two axially spaced stacks of flat springs;

each stack of flat springs consisting of flat metal sheets having spiral kerfs forming axially movable arms across them;

the orientation of the spiral kerfs in the respective stacks being reversed to balance rotational forces between the first and second members that result from relative axial motion between them.

23. The flexure bearing assembly of claim 13, wherein the power conversion machinery is a Stirling cycle machine.

24. The flexure bearing assembly of claim 13, wherein the one member has an outer surface adjacent and complementary to an inner surface of the housing, the outer surface of the one member being centered about the reference axis to form a clearance seal between the outer surface of the one member and the inner surface of the housing.

25. The flexure bearing assembly of claim 13, wherein the remaining member is stationary.

26. In a thermal regenerative machine, such as a Stirling cycle engine or heat pump, an internally mounted flexure bearing assembly comprising:

a stationary first member having inner surfaces centered about a reference axis;

a coaxial second member having outer surfaces adjacent and complementary to the inner surfaces of the housing, the outer surfaces being centered about the reference axis to form a clearance seal between the first and second members;

the second member having a hollow interior structure;

means for imparting coaxial reciprocating motion to the second member relative to the first member along the reference axis; and coaxial flexure means positioned across the hollow interior of the second member, the flexure means including radially spaced connections to the first and second members, respectively, for accommodating relative axial movement and maintaining coaxial alignment between them while assuring effective operation of the clearance seal.

27. The flexure bearing assembly of claim 26, wherein the coaxial flexure means comprises at least two axially spaced stacks of flat springs;

each stack of flat springs consisting of flat metal sheets having spiral kerfs forming axially movable arms across them.

* * * * *